United States Patent [19]

Scozzafava et al.

[11] Patent Number: 4,927,726

[45] Date of Patent: May 22, 1990

[54] PHOTORECEPTOR WITH POLYNUCLEAR BISOXAZOLE OR BISTHIZOLE

[75] Inventors: Michael Scozzafava; Ching W. Tang; Ralph H. Young, all of Rochester, N.Y.

[73] Assignee: Eastman Kodak Company, Rochester, N.Y.

[21] Appl. No.: 232,974

[22] Filed: Aug. 17, 1988

[51] Int. Cl.[5] ..... G03G 5/06; G03G 5/14

[52] U.S. Cl. ..... 430/78; 430/58; 430/59

[58] Field of Search ..... 430/58, 59, 77, 78, 430/512

[56] References Cited

U.S. PATENT DOCUMENTS

| | | | |
|---|---|---|---|
| 3,257,204 | 6/1966 | Sus et al. . | |
| 3,575,996 | 4/1971 | Liechti et al. | 430/77 X |
| 3,887,366 | 6/1975 | Champ et al. . | |
| 4,264,694 | 4/1981 | Pu et al. | 430/58 |
| 4,539,507 | 9/1985 | VanSlyke et al. | 313/504 |
| 4,769,292 | 9/1988 | Tang et al. | 428/917 X |

FOREIGN PATENT DOCUMENTS

| | | | |
|---|---|---|---|
| 62-262052 | 11/1987 | Japan | 430/77 |

*Primary Examiner*—Roland E. Martin

*Attorney, Agent, or Firm*—Willard G. Montgomery

[57] ABSTRACT

Disclosed is a photoreceptor comprising at least one substantially non-charge-injecting contact in a charge-collecting relationship with a solid phase consisting essentially of a compound having the general formula where each R is independently selected from hydrogen, alkyl from $C_1$ to $C_8$, aryl from $C_6$ to $C_{14}$, one or more fused benzene rings formed by adjacent R groups, halogen, cyano, and alkoxy from $C_1$ *to* $C_8$, each X is independently selected from S and O, and $R_1$ is a conjugated bridging group. Also disclosed is a method of making that photoreceptor.

3 Claims, 1 Drawing Sheet

PHOTORECEPTOR WITH POLYNUCLEAR BISOXAZOLE OR BISTHIZOLE

TECHNICAL FIELD

The invention relates to photoreceptors, devices that generate and transport electric charge when exposed to light. In particular, it relates to photoreceptors having a solid phase consisting essentially of a neutral polynuclear bis-oxazole or bis-thiazole compound.

BACKGROUND ART

In electrophotography, photoreceptors frequently comprise a charge-generating material and a charge-transport material, often, but not always, as separate layers. The materials are mounted on a conductive support, which serves as an electrical contact. Electromagnetic radiation impinging on the photoreceptor generates mobile electric charges, or a current.

For applications in electrophotography, particularly in microimaging or very high quality 1:1 electrophotographic reproduction, it is important for a photoreceptor to resist localized "dielectric breakdown". Such "breakdown" makes a small area of the photoreceptor, typically about 5 to about 25 micrometers across, appear light-struck because the photoreceptor is unable to hold a surface charge. Some highly sensitive photoreceptors, including some of the two-layer photoreceptors described above, suffer from an excessively high density of breakdown spots. Although it is believed to involve a localized leakage of electrical current through the photoreceptor, the mechanism of this breakdown is not entirely understood, nor is it possible to predict which materials will be least prone to it.

Polynuclear oxazoles and thiazoles have been used in electrophotographic photoreceptors in a single-layer format, which consists of a mixture of an oxazole or thiazole, a polymeric binder, and sometimes a sensitizing dye all in a thin layer of homogeneous solid solution. See, for example, U.S. Pat. No. 3,257,204 where non-bis compounds are used. Polynuclear oxazoles and thiazoles have also been used as optical brighteners because they fluoresce efficiently in the solid state. See, for example, articles by A. Reiser, *Journal of the American Chemical Society*, 94, 2414 (1972), "Fluorescence of Aromatic Benzoxazole Derivatives"; and H. Gold, "Fluorescent Brightening Agents", *The Chemistry of Synthetic Dyes*, Ed. by K. Venkataraman, Academic Press, New York, 1971, Vol. V, p. 648.

DISCLOSURE OF INVENTION

We have found that certain neutral polynuclear bis-oxazole and bis-thiazole compounds are highly photosensitive when used as the charge-generating material of a photoreceptor. Photoreceptors made using compounds according to this invention have good charge-acceptance (up to 1000 volts on a 10 micrometer film), photosensitivity from about 10 to about 100 ergs/cm$^2$ for a half-potential discharge, and a low dark decay.

Most unexpectedly, we have found that photoreceptors which employ the oxazole or thiazole compounds according to this invention have a surprisingly low density of "dielectric breakdown" spots. As the examples which follow demonstrate, substantially lower densities of dielectric breakdown spots are obtained in photoreceptors using these oxazole or thiazole compounds, compared to similar photoreceptors which do not employ these compounds. The reduction in dielectric breakdown spot density is unexpected, as we are unaware of any theory that relates the chemical structure of these types of pigments to their breakdown resistance.

Photoreceptors according to this invention in which a thin layer of the oxazole or thiazole compound underlies a thin layer of a second pigment, providing a two-ply charge-generating layer, also have a high sensitivity, a low dark decay, and a low density of dielectric breakdown spots. The presence of the second pigment is useful to extend the spectral response of the photoreceptor.

Figure 1:
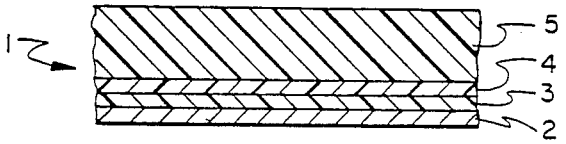
FIG. 1 is a diagrammatic side view in section showing a certain presently preferred embodiment of a composite photoreceptor according to this invention.

In a FIG. 1, a photoreceptor 1 is supported on a contact comprising electrode 2 and optional barrier layer 3, and includes charge-generating layer 4, which contains oxazole or thiazole compounds used in this invention, and a charge-transport layer 5.

Figure 2:
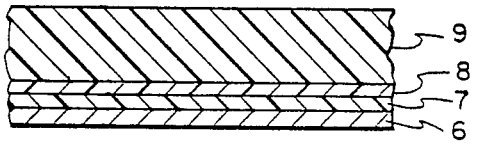
FIG. 2 is a diagrammatic side view in section showing an alternative composite photoreceptor according to this invention.

In FIG. 2, a similar standard composite photoreceptor is shown except that an additional charge-generating layer has been added. In FIG. 2 there is mounted on contact 6 a charge-generating layer 7 which contains an oxazole or thiazole compound used in this invention, a second charge-generating layer 8 which contains a charge-generating pigment, and a charge-transport layer 9.

Figure 3:
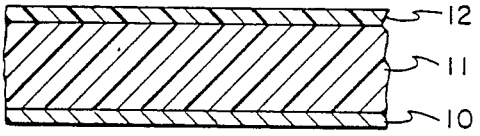
FIG. 3 is a diagrammatic side view in section showing a certain presently preferred embodiment of another alternative photoreceptor according to this invention.

In FIG. 3, the charge-generating layer and the charge-transport layer have been reversed. On contact 10 is formed charge-transport layer 11, and the exposed surface is the charge-generating layer 12, which contains an oxazole or thiazole compound used in this invention.

Figure 4:
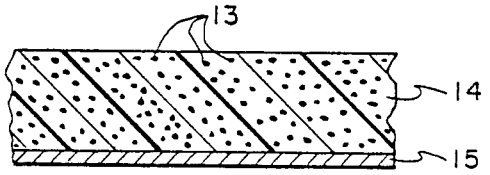
FIG. 4 is a diagrammatic side view in section showing a certain embodiment of a pigment-dispersed photoreceptor according to this invention.

In FIG. 4, the oxazole or thiazole compound used in this invention is in pigment particles 13, which are dispersed in charge-transport material 14 on contact 15. The embodiment of FIG. 4 is not presently preferred as the photoreceptor may not be reusable if all of the charges in the photoreceptor can not be removed after use.

Figure 5:
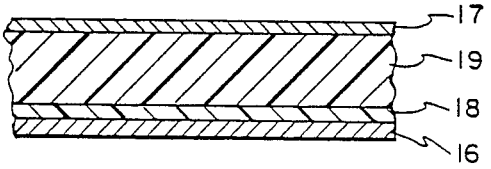
FIG. 5 is a diagrammatic side view in section showing a certain presently preferred embodiment of a photoreceptor according to this invention having two contacts.

In FIG. 5, contacts 16 and 17 sandwich the charge-generating layer 18, which contains an oxazole or thiazole compound used in this invention, and charge-transport layer 19.

In all of the five embodiments shown, protective layers can be placed on the exposed surface to prevent damage to the photoreceptor, as is known in the art.

BEST MODE FOR CARRYING OUT THE INVENTION

In forming a photoreceptor according to this invention, one begins with a contact which is non-charge-injecting. As used herein, the term "contact" means an electrode or an electrode in combination with a barrier layer, the term "substantially charge-injecting" means capable of injecting electrical current in the amount of about 100 nanoamperes per square centimeter or more, and the term "non-charge-injecting" means not substantially charge-injecting. Substantially charge-injecting contacts cannot be used, as they impose a dark current on the photoreceptor which damages or destroys the image if the photoreceptor is used as an electrophotographic photoreceptor, or which must be subtracted if the photoreceptor is used as an ultra-violet detector or a photosensor. However, an electrode that would be substantially charge-injecting by itself can be used in combination with a barrier layer, as long as the combination is non-charge-injecting. Whether or not a contact is substantially charge-injecting depends, in a manner that is not completely understood, upon its composition and the composition of the material into which the charges would be injected. The injection of more than about 100 nanoamperes per square centimeter or sufficient current to produce a surface potential decay of more than about 100 V/sec is not considered to be tolerable. Examples of electrodes which can be non-charge-injecting include any conductive surface such as conducting papers, aluminum-paper laminate, metal foils such as aluminum and zinc foils, metal plates such as aluminum, copper, zinc, brass and galvanized plates, vapor-deposited metal layers (silver, nickel, aluminum) on conventional film supports such as cellulose acetate, poly(ethylene terephthalate), polystyrene, and the like. If the photoreceptor is used as an electrophotographic photoreceptor, only a single non-charge-injecting contact is required, but if the photoreceptor is used as an ultraviolet detector or a photosensor, two opposing non-charge-injecting contacts are used. (See FIG. 5.)

The desirability of including a barrier layer in the contact depends upon how easily charges would be injected from the electrode into the material that is placed immediately against the contact. If that material is a layer of a pigment of the oxazoles or thiazoles used in this invention, a barrier layer is not needed in most cases. However, if that material is a charge-transport material, or the pigments used in this invention are placed in a resinous binder, it may be desirable for the contact to include a barrier layer over the electrode. If the materials adjacent to the barrier layer are used to generate and/or transport holes, the barrier layer should prevent the injection of holes into those materials, and if they generate and/or transport electrons, the barrier layer should prevent the injection of electrons. The barrier layer, in addition to preventing the injection of charges from the electrode into the remainder of the photoreceptor, can also perform the function of improving the adhesion of the subsequent layer or protecting the electrode from attack by solvents used in forming other layers of the photoreceptor. Barrier layers are well known in the art and typically consist of polymers such as cellulose nitrate, polyesters, copolymers of vinylpyrrolidone and vinylacetate, and vinylidene chloride-containing polymers, which can be formed by coating a solution of the polymer on the electrode and evaporating the solvent, or by other techniques known in the art. A suitable thickness for a barrier layer is typically in the range 0.01 to 5 micrometers.

In each of the embodiments shown in FIGS. 1 to 5, the contacts must be non-charge-injecting. Nevertheless, in order for the element to function, each contact must be either capable of collecting photogenerated charges from the remainder of the element or be capacitively coupled to those charges. If the contact is to collect charges, charges must either enter the contact or accumulate at its surface. A contact that either collects photogenerated charge or is capacitively coupled to photogenerated charge is said to be in a charge-collecting relationship to the charge-generating and charge-transporting parts of the element.

A charge-generating layer is a layer of material that generates electron/hole pairs when exposed to electromagnetic radiation. A charge-generating layer containing the pigment used in this invention can be deposited in several different ways. Since most of the oxazoles and thiazoles used in this invention can be vapor deposited, heating them in a vacuum chamber to vaporize them and permit their condensation results in the formation of the charge-generating layer. An alternative way of forming the charge-generating layer is to make a dispersion or solution of the oxazole or thiazole compound in a solution of an organic binder which is applied to the surface to be coated; as the solvent evaporates a coating is formed on the surface which contains discrete particles of the oxazole or the thiazole embedded in the binder. This latter process is a simpler manufacturing process as no vacuum chamber is needed, but at present the vapor deposition process is preferred as it produces very good quality photoreceptors. Binders suitable for use in the latter process include various insulating organic polymers such as styrene-butadiene copolymers; silicone resins; styrene-alkyd resins; silicone-alkyd resins; soya-alkyd resins; poly(vinyl chloride); poly(vinylidene chloride); vinylidene chloride-acrylonitrile copolymers; poly(vinyl acetate); vinyl acetate-vinyl chloride copolymers; poly(vinyl acetals) such as poly(vinyl butyral); polacrylic and polymethacrylic esters such as poly(methyl methacrylate), poly(n-butyl methacrylate), poly(isobutyl methacrylate); polystyrene; nitrated polystyrene; polymethylstyrene; isobutylene polymers; polyesters such as poly[ethylene-co-alkylenebis (alkyleneoxyaryl)-phenylene-dicarboxylate]; phenolformaldehyde resins; ketone resins; polyamides; polycarbonates; polythiocarbonates; poly[ethylene-co-isopropylidene-2,2-bis(ethyleneoxy-phenylene) terephthalate]; copolymers of vinyl haloarylates; poly(ethylene-co-neopentyl terephthalate); and vinyl acetate copolymers such as poly(vinyl-m-bromobenzoate-co-vinyl acetate), and others well known in the art. Whether or not a binder is present, the charge-generating layer should be about 0.03 to about 2 micrometers thick, as thinner layers may not absorb all of the light impinging upon the photoreceptor, with the result that the photoreceptor will be less sensitive than it could be, and thicker layers may trap electrons after the photoreceptor is used, which may be difficult to remove, and result in other disadvantages as well, while not offering any significant advantage.

If the structure shown in FIG. 2 is to be formed, then over the above-described charge-generating layer there is applied a second charge-generating layer containing a second pigment. This two-ply structure is useful when it is desirable to extend the response of the photoreceptor into the visible range or into another wavelength range at which the oxazoles and thiazoles used in this invention do not absorb. The two-ply structure shown in FIG. 2 is also useful when one desires to use the second pigment but finds that it is unsatisfactory due to its high density of breakdown spots. The use of the charge-generating layer of this invention in combination with the second pigment will then alleviate the breakdown problem. (In this modification, the charge-generating ability of the oxazole or thiazole compounds used in this invention is not necessarily exploited.) The second charge-generating layer typically also has a thickness range of about 0.03 to about 2 micrometers and can be formed in a variety of ways that are standard in the art using well known charge-generating pigments with or without the presence of binders. Examples of such pigments include amorphous selenium and alloys thereof, trigonal selenium; phthalocyanine compounds such as metal-free phthalocyanine, magnesium phthalocyanine, vanadyl phthalocyanine, titanyl phthalocyanine, tetrafluorotitanyl phthalocyanine, and bromoindium phthalocyanine; derivatives of 3,4,9,10-perylenetetracarboxylic acid such as the diimides formed with aniline or phenethylamine and the bis-benzimidazole formed with 1, 2-phenylenediamine; indigo and thioindigo compounds such as 4,7,4',7'-tetrachlorothioindigo; polycyclic quinones; squaraines; and bisazo compounds.

The charge-transport layer transports either holes or electrons, whichever are generated by the charge-generation layer. The charge-transport layer is typically deposited from a solution of the binder and the transport material, but it is also possible to vapor deposit the transport material alone. Also, a binder can be omitted if the transport material is polymeric such as polyvinylcarbazole. The charge-transport layer is conventional in the art and can also be formed using other standard techniques and materials that are well known in the art. An example of a material suitable for use as a charge-transport layer is a vapor deposited amine which transports holes and has the formula

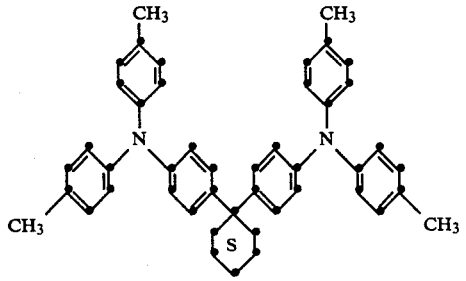

where "S" indicates that the ring is saturated. Other suitable charge-transport materials include polysilanes, tetraarylbenzidine compounds such as tetratolylbenzidine, bis(4-diethylamino-2-methyl-phenyl)-phenylmethane and tri-p-tolylamine in a polymeric binder such as a polycarbonate. The charge-transport layer is typically about 2 to about 100 micrometers thick as a thinner layer may not result in enough of a voltage difference between the charged and the uncharged areas of the photoreceptors to give image contrast, and thicker layers seem to offer no particular advantage and require more voltage to charge.

Optional overcoat layers can also be used over the charge-transport layer. For example, to improve surface hardness and resistance to abrasion, the surface layer of the element can be coated with one or more electrically insulating organic polymer coatings or electrically insulating inorganic coatings. A number of such coatings are well known in the art. Useful overcoats are described, for example, in *Research Disclosure*, "Electrophotographic Elements, Materials and Processes", Vol. 109, p. 63, paragraph V, May, 1973.

The embodiment of FIG. 4 can be formed by dispersing the pigment particles of this invention in a solution of the charge-transport material and a binder in a solvent. The dispersion is then applied over the contact and the solvent is evaporated to form the photoreceptor. In that embodiment the dispersed particles can range from about 0.05 to about 5 micrometers, and preferably about 0.1 to about 1.0 micrometers in size, and they can constitute from about 0.1 to about 80% by weight of the layer, depending on materials and purpose.

The oxazoles and thiazoles that are useful in this invention are pigments having the general formula

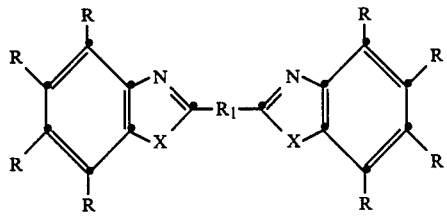

where each R is independently selected from hydrogen, alkyl from $C_1$ to $C_8$, aryl from $C_6$ to $C_{14}$, one or more fused benzene rings formed by adjacent R groups, halogen, cyano, and alkoxy from $C_1$ to $C_8$, each X is independently selected from S and O, and $R_1$ is a conjugated bridging group, where "conjugated" means that at least one path exists where single bonds alternate with double or triple bonds. Mixtures of oxazoles and thiazoles are also contemplated. Examples of suitable conjugated bridging groups include

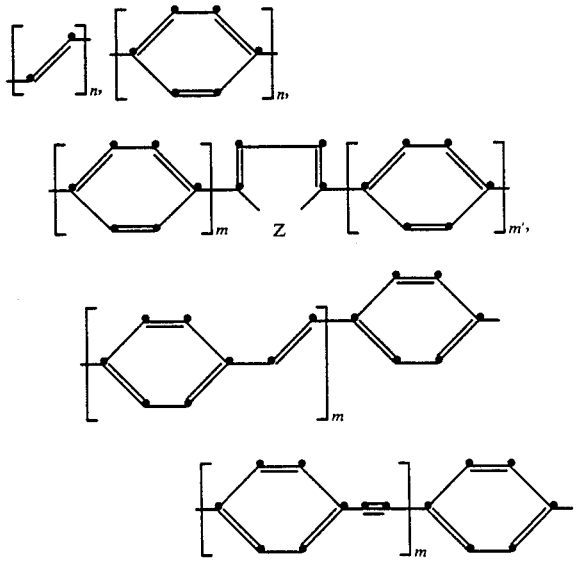

where Z is 0, S, or Se, n is 1 to approximately 5, and each m and m' is independently selected from 0 to about 3.

It should be noted that the oxazoles and thiazoles used in this invention are not charged, but are neutral compounds. Of all the oxazoles and thiazoles that are included within that general formula, those that are insoluble in solvents are preferred as it is easier to form the photoreceptor when the oxazole or thiazole cannot dissolve in the solvent used to form a subsequent layer of the photoreceptor. However, if a subsequent layer is formed by vapor deposition it is not necessarily desirable for the oxazole or thiazole to be solvent insoluble. The preferred oxazoles and thiazoles are benzoxazoles and benzthiazoles as they have been tried experimentally and have been found to work well. However, if two R groups in the general formula are adjacent, other fused benzene rings can be formed such as naphthalene, phenanthrene, and anthracene. Preferred oxazoles and thiazoles are also those that are capable of vapor deposition so that they can be vaporized without destruction of the molecular structure. In some applications, such as where the image is fixed on a photoconductor, it is desirable that the oxazoles and thiazoles do not absorb in the visible range in order to prevent a discolored background. Examples of suitable oxazoles and thiazoles that fall within the scope of the general formula include

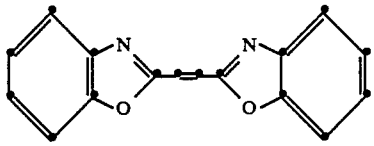

vinylenebis(2-benzoxazole)

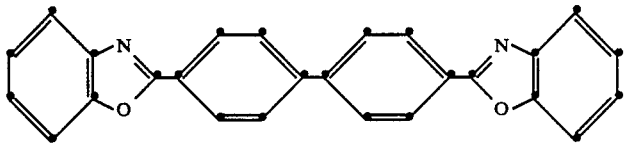

2,2'-(p-biphenylene)bisbenzoxazole

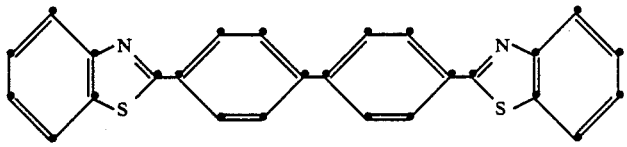

2,2'-(1,1'-biphenyl)-4,4'-diylbis-benzothiazole

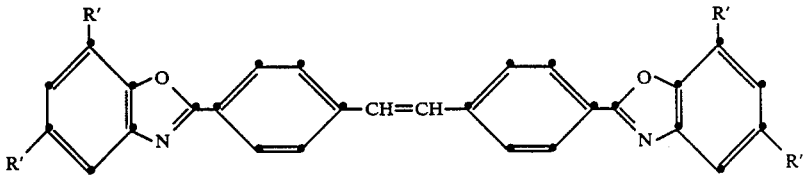

4,4'-di-(5,7-di-tert-pentylbenzoxazol-2-yl)stilbene,
where R' = tert-pentyl, $-C(CH_3)_2C_2H_5$

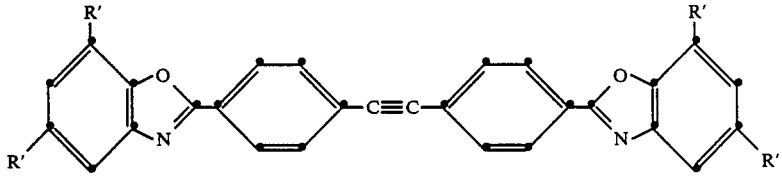

2,2'-(1,2-ethynediyldi-4,1-phenylene)bis[5,7-bis
(1,1-dimethylpropyl)-benzoxazole]

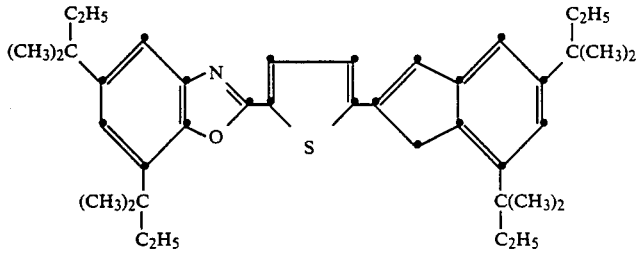

2,5-bis[5,7-di(2-methyl-2-butyl)-2-benzoxazolyl]thiophene

-continued

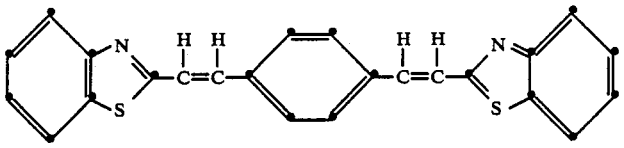

2,2'-(1,4-phenylenedivinylene)bisbenzothiazole

A preferred oxazole, which has been found to work very well, is 4,4'-bis(2-benzoxazolyl)stilbene (hereinafter referred to as "BBS"), which has the formula

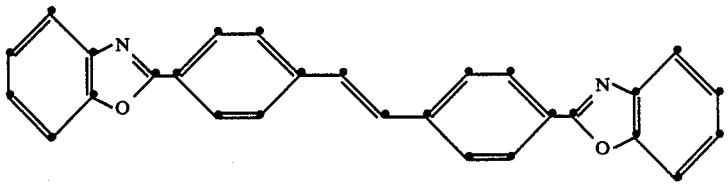

The oxazoles and thiazoles are present in the photoreceptor as a neat solid phase, which means that they are in a separate solid phase which consists essentially of 100% of the thiazole or oxazole, and they are not in solid solution with other materials. It is expected that homogeneous dispersions, or solid solutions, of the oxazoles or thiazoles would be disadvantageous because the photographic speed of the photoreceptor would be much lower. When the photoreceptor is charged, the charge-generating layer containing the oxazole or thiazole typically generates holes but it may be possible to also make the charge-generating layer generate electrons. Either positive/positive or negative/positive images are possible using the photoreceptor of this invention.

The following examples further illustrate this invention.

EXAMPLE 1

In this example, an aluminum layer on a polyester support served as the non-charge-injecting contact. The charge-generating layer was a 0.08 micrometer film of "BBS" prepared by conventional vapor deposition. The background pressure was typically $10^{-5}$ torr ($10^{-3}$ Pa); the source and substrate temperatures were about 300° C. and about 25° C., respectively. The charge-transport layer was a 10 micrometer film of 1,1-bis(4-di-p-tolylaminophenyl)cyclohexane, vapor deposited on top of the charge-generating layer. At a surface potential of −460 volts, the dark decay was 3 volts/sec, and 6.7 ergs/cm$^2$ incident light at 400 nm discharged the surface to −230 volts.

EXAMPLE 2

The non-charge-injecting contact was a polyester coated with conductive cuprous iodide and overcoated with a cellulose nitrate barrier layer. The charge-generating layer was a 0.08 micrometer film of "BBS". The charge-transport layer was a 10 micrometer film of tri-p-tolylamine in a polycarbonate sold by General Electric under the trade designation "Lexan 145"in a weight ratio of 35:65, coated from a dichloromethane solution. The photoreceptor could be charged to −1000 volts with a 2.5 volts/sec dark decay. Photodischarge from −1000 volts to −500 volts required 19 ergs/cm$^2$, and photodischarge from −600 volts to −300 volts required 12.4 ergs/cm$^2$ incident light, both at 375 nm. At −600 volts, the density of "dielectric breakdown" spots was about 120cm$^2$ of photoreceptor. The spots varied in size from a few micrometers to about 15 micrometers.

EXAMPLE 3

The photoreceptor was similar to that of Example 2 except that the charge-transport layer was 4,4'-diethylamino-2,2'-dimethyltriphenyl menthane in "Lexan 145" at a 40:60 weight ratio. At −500 volts, the dark decay was 3 volts/sec, and 20 ergs/cm$^2$ of 375 nm incident light produced a discharge to −250 volts. At −500 volts, the density of breakdown spots was about 110/cm$^2$.

EXAMPLES 4 to 8

Photoreceptors employing oxazole or thiazole compounds according to this invention as the charge-generating layer were prepared as in Example 1, except that the contact was a polyester coated with cuprous iodide and overcoated with a cellulose nitrate barrier layer. The following table gives the oxazole and thiazole compounds tested and the results of tests performed on the photoreceptor.

| Example | Charge-Generating Layer | Photosensitivity ergs/cm$^2$, −600 V to −300 V | Incident Light (nm) | Dark Decay (V/sec) |
|---|---|---|---|---|
| 4 | 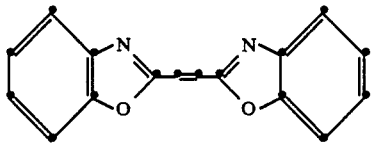 | 77 | 390 | 4 |
| 5 | 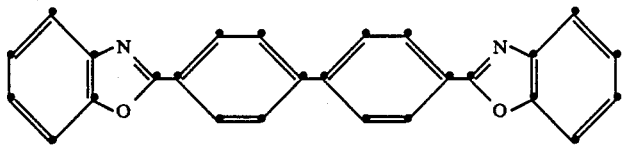 | 26 | 385 | 2 |
| 6 | 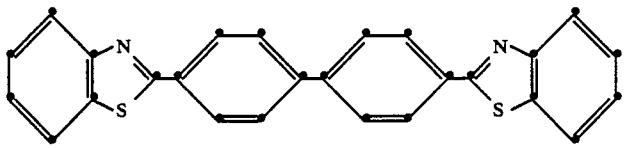 | 19 (−370 to −185 V) | 375 | 3 |
| 7 | 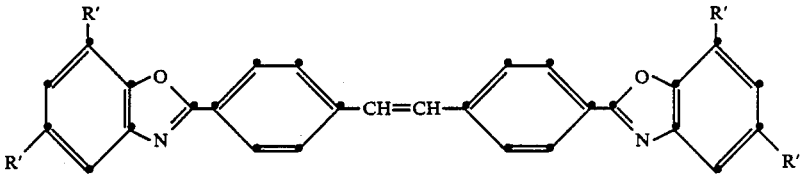 | 52 | 380 | 2 |
| 8 | 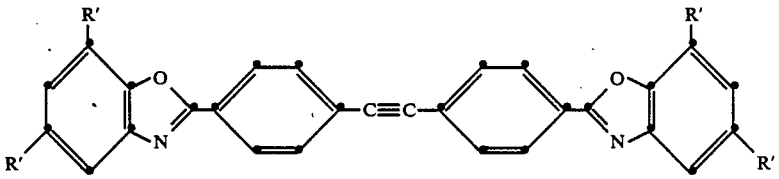 | 88 | 380 | 1.5 |

The above table shows that the sensitivities of the oxazole and thiazole compounds (exposure required for half-discharge) were below 100 ergs/cm$^2$, and their dark decay rates (at −600 volts) were usually no greater than 4 volts/sec.

EXAMPLE 9

A photoreceptor was prepared by evaporating 0.08 micrometers of "BBS" on a polyester support coated with nickel, which formed the non-charge-injecting contact, and a solution coating of a 10 micrometer charge-transport layer of 4,4'-diethyl-amino-2,2'-dimethyltriphenyl methane and "Lexan 145"in a 40:60 weight ratio. At −600 volts, the dark decay was 2.5 volts/sec; 34 ergs/cm$^2$ at 375 nm produced a discharge to −300 volts, and there were only about 200 breakdown spots/cm$^2$. On a comparison film which lacked only the "BBS" layer, charging to −600 volts produced 1000 breakdown spots/cm$^2$.

EXAMPLE 10

This photoreceptor consisted of a polyester coated with cuprous iodide and a cellulose nitrate barrier layer as the non-charge-injecting contact, a 0.08 micrometer vapor-deposited layer of "BBS" as a first charge-generating layer, a 0.08 micrometer layer of vapor-deposited Thiofast Red as a second charge-generating layer, and 10 micrometers of tri-p-tolylamine/"Lexan" in a 35:65 weight ratio as the charge-transport layer. Thiofast Red has the formula

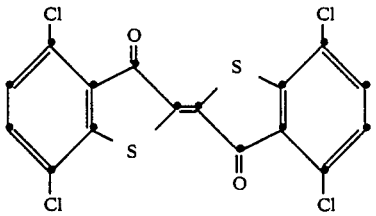

At −600 volts the dark decay was 3 volts/sec, and 8.5 ergs/cm$^2$ of incident light at 540 nm produced a discharge to −300 volts. The density of breakdown spots at −600 volts was about 300 spots/cm$^2$. A control sample which lacked the "BBS" layer had a dark decay of 2.5 volts/sec at −600 volts and required 14 ergs/cm$^2$ at 540 nm to discharge it to −300 volts. It had about 1600 breakdown spots/cm$^2$ at −600 volts. Thus, the inclusion of the "BBS" layer was responsible for reducing the density of breakdown spots to a surprising degree. A control (that of Example 2) which lacked only the Thiofast Red layer, required more than 10,000 ergs/cm$^2$ at 540 nm irradiation for a discharge from −600 volts to −300 volts, presumably because the "BBS" layer has no absorption at 540 nm.

INDUSTRIAL APPLICABILITY

The photoreceptor of this invention is useful as an electrophotographic photoreceptor, which means that a pattern of electrostatic charge can be formed on the photoreceptor. Electrophotographic photoreceptors can be used in electrostatographic copying machines, where the electrostatic image is typically developed with a toner and the toner is transferred to and fixed on a receiver, such as paper. The photoreceptor is also useful in devices that do not require the formation of an electrostatic charge pattern on a photoconductor, such as an ultraviolet detector or a photosensor.

The invention has been described in detail with particular reference to preferred embodiments thereof, but it will be understood that variations and modifications can be effected within the spirit and scope of the invention.

We claim:

1. A photoreceptor comprising at least one non-charge-injecting contact in a charge-collecting relationship with a solid phase consisting essentially of a compound having the formula

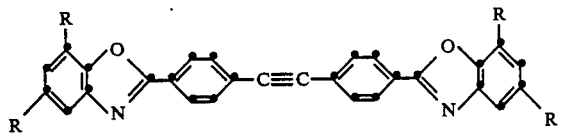

wherein R is $—C(CH_3)_2C_2H_5$.

2. A photoreceptor according to claim 1 wherein said solid phase consists of particles suspended in a charge-transport material.

3. A photoreceptor according to claim 1 wherein said contact comprises a charge-injecting electrode and a barrier layer.

* * * * *